US006156265A

United States Patent [19]

Sugimoto

[11] Patent Number: 6,156,265

[45] **Date of Patent: *Dec. 5, 2000**

[54] POWDER COMPACTING APPARATUS AND METHOD OF FORMING HELICAL GEAR WHEEL USING SAID POWDER COMPACTING APPARATUS

[75] Inventor: Mamoru Sugimoto, Hyogo, Japan

[73] Assignee: Sumitomo Electric Industries, Ltd., Osaka, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/914,185

[22] Filed: Aug. 19, 1997

[30] Foreign Application Priority Data

Aug. 19, 1996 [JP] Japan ..... 8-217139

[51] Int. Cl.[7] ..... B22F 3/00

[52] U.S. Cl. ..... 419/66; 425/355; 425/356; 425/DIG. 5; 425/78

[58] Field of Search ..... 425/78, 352, 354, 425/355, 356, DIG. 5; 264/120, 294, 325; 419/66

[56] References Cited

U.S. PATENT DOCUMENTS 3,694,127 9/1972 Takahashi et al. ..... 425/78

3,909,167 9/1975 Signora ..... 425/78

FOREIGN PATENT DOCUMENTS 47-15760 8/1972 Japan .

48-29901 9/1973 Japan .

7-150204 6/1995 Japan .

8-104904 4/1996 Japan .

*Primary Examiner*—Jan H. Silbaugh

*Assistant Examiner*—Kenneth M. Jones

*Attorney, Agent, or Firm*—Sughrue, Mion, Zinn, Macpeak & Seas, PLLC

[57] ABSTRACT

In the case where an upper punch and a die are made rotatable, a lower punch that is fixed in a conventional example is rotatably supported. Further, a guide mechanism with fixed helical lead for guiding the die is constructed of a guide whose lead is identical to a lead of helical gear contour, and a cam follower that engages with the guide. The guide and the cam follower are arranged so as to correspond to the die and a part with fixed helical lead that is a newly arranged component in the invention. The meshed portion between the helical gear contours of the upper and lower punches and helical gear contours formed on a die or a core rod is free from any excessive force even when a lead-phase shift occurs between helical gears formed on upper and lower punches due to the flexing of the punches during compression.

8 Claims, 8 Drawing Sheets

POWDER COMPACTING APPARATUS AND METHOD OF FORMING HELICAL GEAR WHEEL USING SAID POWDER COMPACTING APPARATUS

BACKGROUND OF THE INVENTION

The invention relates to a powder compacting apparatus for forming a helical gear wheel by compressing powder and to a method of forming a helical gear wheel using such powder compacting apparatus.

In the case where a helical gear wheel is formed using a powder compacting apparatus having an upper punch, a lower punch, a die, and a core rod, the upper punch and the lower punch that are involved in the forming of helical gear, as well as the die or the core rod that moves relative to the upper punch and the lower punch in axial directions while meshed with the upper punch and the lower punch through the helical gears must be relatively rotated in accordance with a lead of the helical gear during the powder compression process in which a powder material is compressed in the die and during the withdrawal process in which a green compact obtained after the completion of the powder compression process is ejected out of the die.

As means for relatively rotating the upper and lower punches and the core rod, the following methods are known. (1) A die or a core rod having a helical gear contour for forming a helical gear is fixed and an upper punch and a lower punch are rotated. (2) A die or a core rod having helical gear for forming and an upper punch are rotated and a lower punch is fixed.

FIG. 1 outlines a powder compacting apparatus adopting method (1), and FIGS. 2 and 3 outline powder compacting apparatuses adopting method (2). FIGS. 1 and 2 show powder compacting apparatuses for forming internal helical gear wheels, in each of which helical gear contour $G_1$, is formed on an outer circumference of a core rod 9, and helical gear contours $G_2$, $G_3$ meshable with the helical gear contour $G_1$ are formed on inner circumferential portions of an upper punch 1 and a lower punch 7, respectively.

Further, FIG. 3 shows a powder compacting apparatus for forming an external helical gear wheel, in which helical gear contour $G_1$, is formed on an inner circumferential portion of a die 5, and helical contours $G_2$, $G_3$ meshable with the helical gear contour $G_1$ are formed on outer circumferential portions of an upper punch 1 and a lower punch 7, respectively.

It may be noted that the core rod 9 is fixed to a yoke plate 10 and the lower punch 7 on a base plate 8 is rotatably supported through a bearing 14 in FIG. 1. It may be further noted that the lower punch 7 is fixed onto the base plate 8 and the core rod 9 on the yoke plate 10 is rotatably supported through the bearing 14 in FIG. 2. Reference numeral 15 in FIG. 2 denotes guide pins engaged with grooves which have the same lead as that of the helical tooth $G_1$ portion. The core rod 9 rotates so as to correspond to the lead of the helical gear contour $G_1$ when the core rod 9 ascends while guided by the guide pin 15.

The lower punch 7 is fixed and the die 5 is rotatably supported in FIG. 3. The die 5 is constructed so that the lead phase thereof is adjusted with reference to the lower punch by engaging a guide groove 16 (having the same lead as the helical gear contour $G_1$disposed on the lower punch 7 with the guide pin 15. When the die 5 ascends, the die 5 is rotated while guided by the guide groove 16.

The upper punch 1 is rotatably supported in both apparatuses so that the helical gear contour $G_2$ can be meshed with the helical gear contour $G_1$ correctly. A guide groove 18 whose lead is identical to the lead of helical gear contour $G_1$ is also disposed on the upper punch 1. The upper punch 1 starts rotating from a predetermined position while descending and while being guided by the guide pin 17 that is engaged with the guide groove 18. That is, the upper punch 1 starts rotating from a position at which the guide plate 4 that is descending up to some position together with the upper plate 2 has movement regulated by the guide stopper 13. Then, the upper punch 1 meshes with the helical contour gear $G_1$ and is pushed into the die 5.

As a result of the upper punch 1 having been pushed into the die 5, a powder material M in a cavity formed in the upper punch 1, the die 5, the lower punch 7, and the core rod 9 is compressed into a green compacts A. The green compact A is ejected out of the die 5 by the forced lowering from the compression-completed points of the die 5 and the core rod 9 (the lowering of the die 5 and the core rod 9 prior to the forced lowering takes place spontaneously).

It may be noted that some of the apparatuses adopting method (2) take care of elastic distortions during compression of the upper and lower punches (Unexamined Japanese Patent Publication No. Hei. 7-150204).

The apparatus adopting method (1) (e.g., the apparatus shown in FIG. 1) ejects the green compact A out of the die 5 while rotating the green compacts A. Therefore, the green compacts A is chipped and cracked.

To overcome this problem, the apparatus adopting method (2) that can eject the green compacts A out of the die without rotating the green compact A is often used. However, this apparatus has the following shortcoming. If the lower punch 7 is long or slender, the lower punch 7 is elastically deformed and largely flexed due to a load applied thereto during compression, which in turn causes a lead-phase shift between the helical gear contours $G_1$ and $G_3$. As a result, an unintentional, excessive force is applied to the meshed portion between both helical gear contours $G_1$ and $G_3$ and the engaged portion between the guide pins 15, 17. Hence, the die assembly may, in some cases, be broken.

To overcome this shortcoming, Unexamined Japanese Patent Publication No. Hei 7-150204 has disclosed an apparatus in which elastic distortions of the upper and lower punches are sensed by sensors so that rotation of the upper punch is corrected by adjusting the height of the guide plate during compression. This apparatus can prevent errors in meshing the helical gears of the upper and lower punches with the helical gear of the die by correcting a lead-phase shift between the helical gears of the upper and lower punches while correcting the rotation of the upper punch. Therefore, the problem of die assembly breakage can be overcome. However, a distortion sensor, a guide plate height adjusting mechanism, and a device for controlling a drive source of the height adjusting mechanism based on an output of the sensor must be additionally provided, which disadvantageously complicates the structure of the powder compacting apparatus and increases the price thereof.

Further, the lower punch flexed due to compression returns when the pressure is released after the compression. Therefore, the green compact is raised in the die and rotates due to restitution of the lower punch from flexure. As a result, the green compact is not completely free from chipping and cracking. This shortcoming is addressed also in the apparatuses shown in FIGS. 2 and 3.

SUMMARY OF THE INVENTION

The invention has been made in view of the aforementioned circumstances. The object of the invention is, therefore, not only to improve die assembly protection effects by absorbing a lead-phase shift caused by the flexing of the lower punch by means of a simple method requiring a small increase in cost, but also to prevent the chipping and cracking of green compact by preventing the green compacts from being rotated by restitution of the lower punch from flexure.

To overcome the aforementioned problems, the invention provides the following apparatuses I and II.

Apparatus I

A powder compacting apparatus for forming an external helical gear wheel which includes: a die having helical gear contour formed on an inner circumferential portion thereof; an upper punch and a lower punch having helical gear contours formed on outer circumferential portions thereof, the helical gear contours being meshable with the helical gear formed on the die; a core rod; and a guide mechanism with fixed helical lead for guiding the die;

wherein the die, the upper punch, and the lower punch are rotatably supported; the guide mechanism with fixed helical lead is constructed of a guide and a cam follower, the guide having a lead identical to a lead of the helical gears, the cam follower slidably engaging with a cam for filling of the guide and a cam for pressing and ejecting facing opposite to the cam for filling, the guide and the cam follower being arranged so as to correspond to the die and a part with fixed helical lead;

the upper punch meshes with the die through the helical gear contour and is pushed into the die while rotating, so that a powder material within a cavity formed of the die, the upper punch, the lower punch, and the core rod is compressed; and a green compact formed after the powder material has been compressed is ejected out of the die by the moving in an axial direction of the die and the core rod relative to the upper punch and the lower punch.

Apparatus II

A powder compacting apparatus for forming an internal helical gear wheel which includes: a core rod having helical gear contour formed on an outer circumferential portion thereof; a die; an upper punch and a lower punch having helical gear contours formed on inner circumferential portions thereof, the helical gears being meshable with the helical gear formed on the core rod; and a guide mechanism with fixed helical lead for guiding the core rod; wherein the core rod, the upper punch, and the lower punch are rotatably supported; the guide mechanism with fixed helical lead is constructed of a guide and a cam follower, the guide having a lead identical to a lead of the helical gear contours, the cam follower slidably engaging with a cam for filling of the guide and a cam for pressing and ejecting facing opposite to the cam for filling, the guide and the cam follower being arranged so as to correspond to the die and a part with fixed helical lead;

the upper punch meshes with the core rod through the helical gear contour and is pushed into the die while rotating, so that a powder material within a cavity formed of the die, the upper punch, the lower punch, and the core rod is compressed; and a green compacts formed after the powder material has been compressed is ejected out of the die by the moving in an axial direction of the die and the core rod relative to the upper punch and the lower punch.

In these apparatuses, the cam follower is formed of a pin which contacts a cam surface of the guide locally, and a relief portion is formed on the cam for filling, wherein the relief portion provides an axially extending space between the cam for filling and the pin. This space is equivalent to at least an amount of flexure of the lower punch during compression. As a result of this arrangement, the green compacts can be caused to follow the die and the core rod without being rotated. Hence, the problem that the green compacts is rotated by restitution of the lower punch from flexure can be overcome simultaneously.

The powder compacting apparatus for forming an external helical gear wheel proposed as Apparatus I not only as rotatably supports the lower punch 7 that is fixed in the conventional apparatus shown in FIG. 3, but also includes the guide mechanism with fixed helical lead disposed between the die and an additionally provided part with fixed helical lead (reference numeral 22 in FIG. 4). This is different than the guide mechanism with fixed helical lead that is interposed between the die 5 and the lower punch 7 in FIG. 3 (the guide mechanism with fixed helical lead being constructed of the guide pin 15 and the guide groove 16 in FIG. 3).

Further, the powder compacting apparatus for forming an internal helical gear wheel proposed as Apparatus II not only as rotatably supports the core rod, that is fixed in the conventional apparatus in the case of rotating the upper and lower punches, but also includes the guide mechanism with fixed helical lead for guiding the core rod disposed between the core rod and the part with fixed helical lead.

Both apparatuses require only a small number of additional parts, which in turn contributes to avoiding not only a complicated structure but also an increased manufacturing cost.

The operation of the aforementioned featured portions will hereunder be described.

Upon starting the compression of the powder material after the upper punch has been pushed into the die, the upper and lower punches start flexing. As a result of the flexure, a lead-phase shift occurs between the helical gears of the upper and lower punches, and the meshing of the helical gears of the upper and lower punches with the helical gear of the die or the core rod is shifted to allow an unintentional, excessive force to be applied to the meshed portion. However, in the invention, when a pushing force is applied to the meshing surfaces between the helical gear for forming formed on the die or the core rod and the helical gear formed on the lower punch, the lower punch rotates so that the lead-phase shift between the upper and lower punches is spontaneously corrected. Therefore, there is no likelihood that unintentional, excessive force will be applied to the meshed portion of the helical gear, which in turn excludes the possibility that unintentional, excessive force will be applied to the engaged portion of the cam follower of the guide mechanism with fixed helical lead.

Further, at the time of ejecting the green compacts out of the die, the die or the core rod that is meshed with the green compacts through the helical gear lowers while rotating so as to be guided by the guide mechanism with fixed helical lead. Therefore, the green compact can be ejected out of the die without being rotated.

The operation of the relief portion arranged on the cam for filling of the guide mechanism with fixed helical lead will be described next.

The pressure applied by the punches is released during the process between the completion of the compression of the powder material and the start of the ejection of the green compacts. At the time of releasing the pressure, the punches that have flexed during the compression process elastically return instantaneously. As a result of such instantaneous return of the punches from flexure, the green compact meshed with the die or the core rod through the helical gear is raised by the lower punch and rotates.

In order to prevent the green compact from rotating, an axially extending space is produced between the cam for filling and the cam follower engageable with the cam for filling by arranging the aforementioned relief portion on the cam for filling. As a result of this arrangement, the green compact can be caused to follow the expansion of the lower punch together with the die or the core rod until the space is filled up. Thus, as the movement of the green compact relative to the die or the core rod in the axial direction is stopped, the green compact does not rotate, which in turn ensures that the green compact will not chip nor crack.

DETAILED DESCRIPTION OF THE PREFERRED EMBODIMENTS

Figure 1:
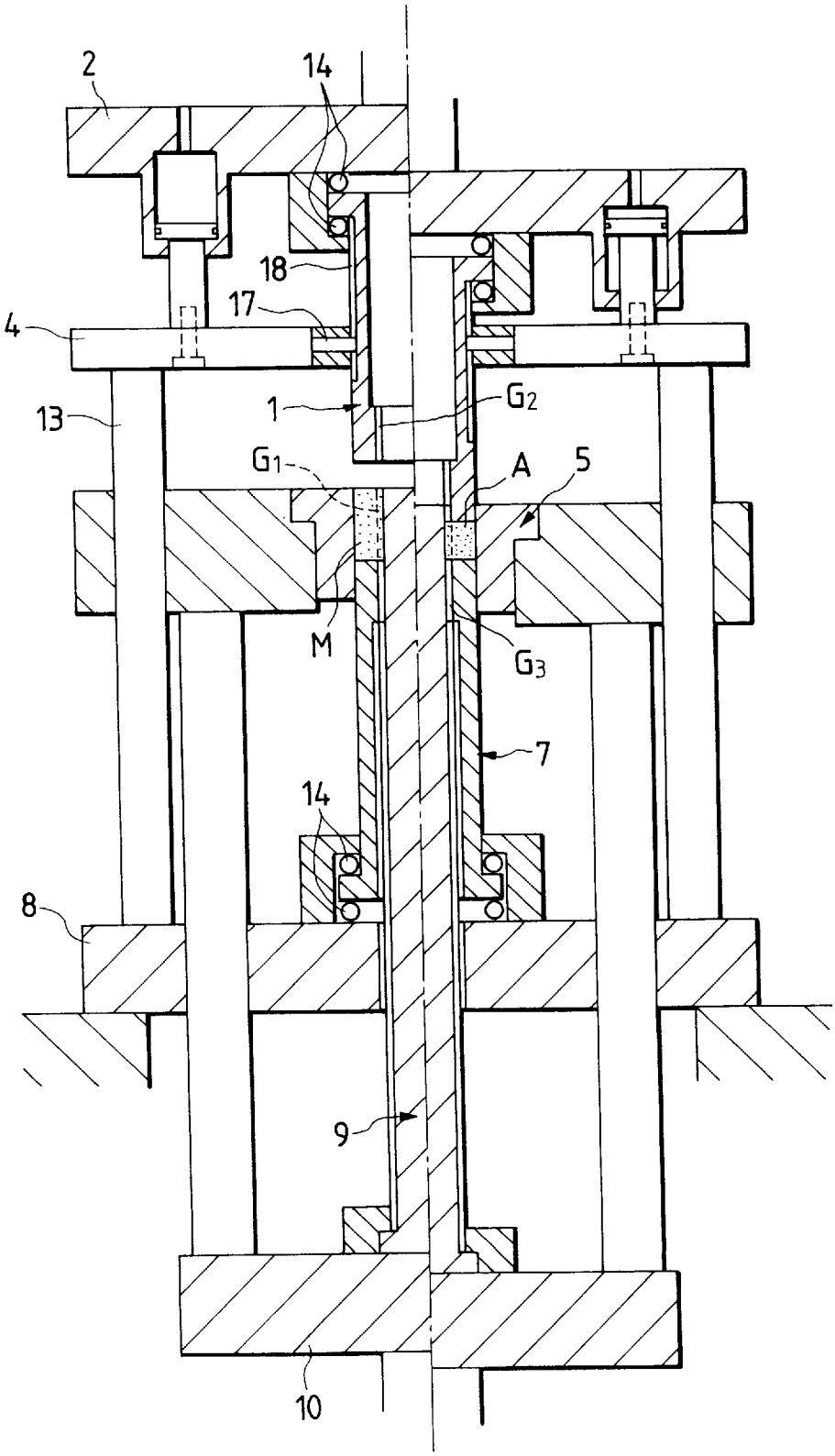
FIG. 1 is a sectional view showing a conventional apparatus for forming an internal helical gear wheel in which upper and lower punches are rotated and a core rod is fixed.
Figure 2:
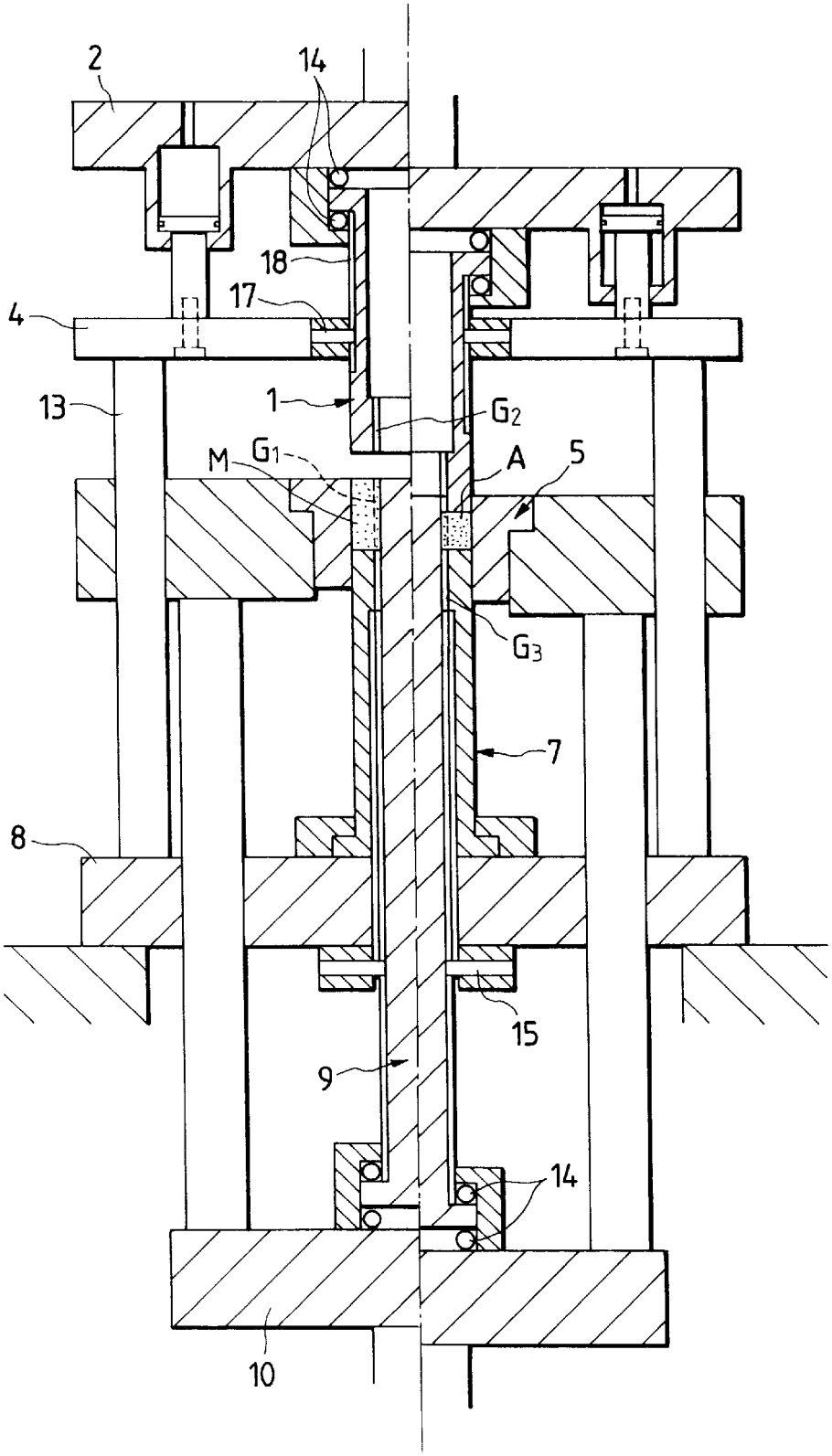
FIG. 2 is a sectional view showing a conventional apparatus for forming an internal helical gear wheel in which an upper punch and a core rod are rotated and a lower punch is fixed.
Figure 3:
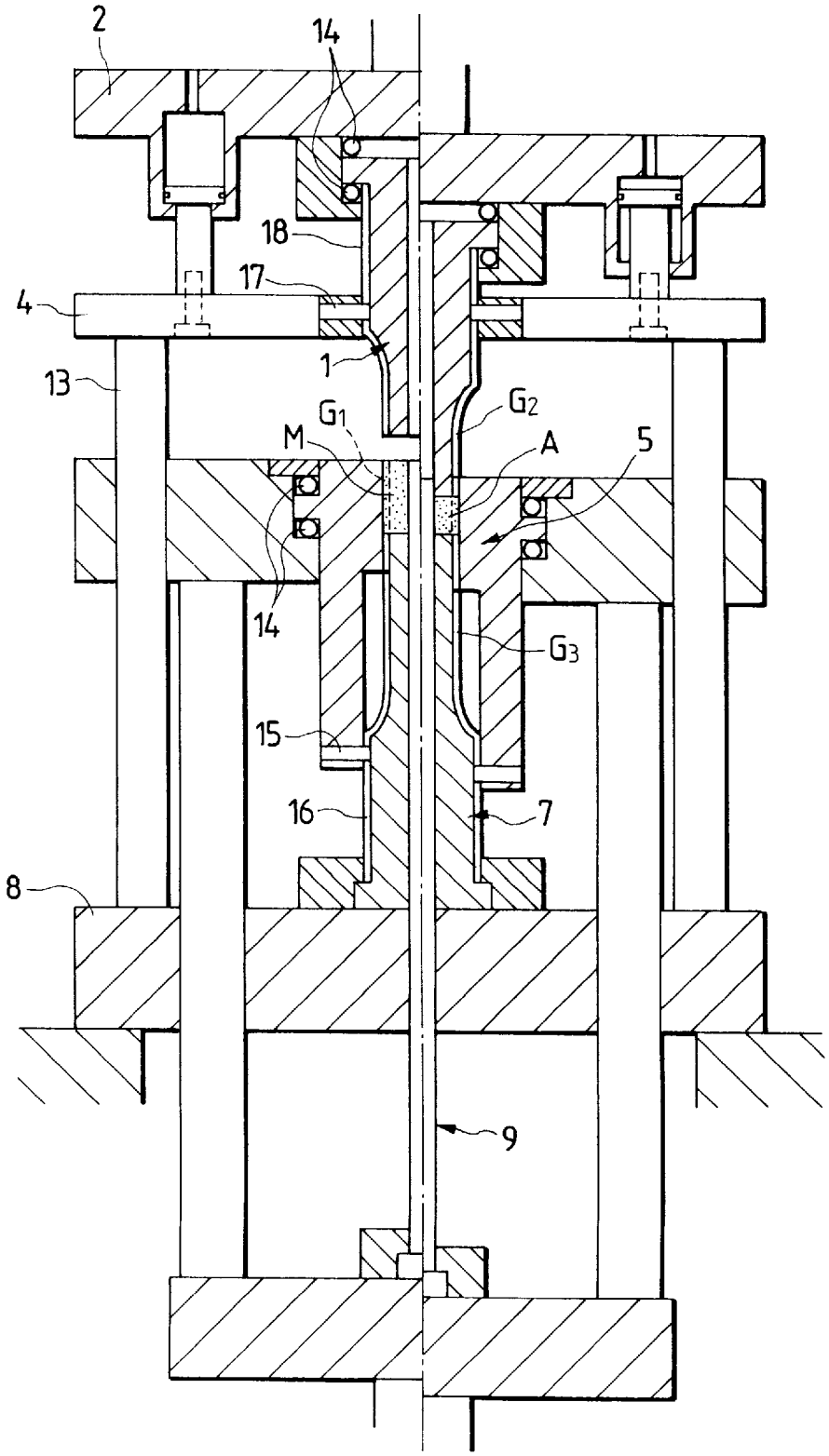
FIG. 3 is a sectional view showing a conventional apparatus for forming an external helical gear wheel in which an upper punch and a die are rotated and a lower punch is fixed.
Figure 4:
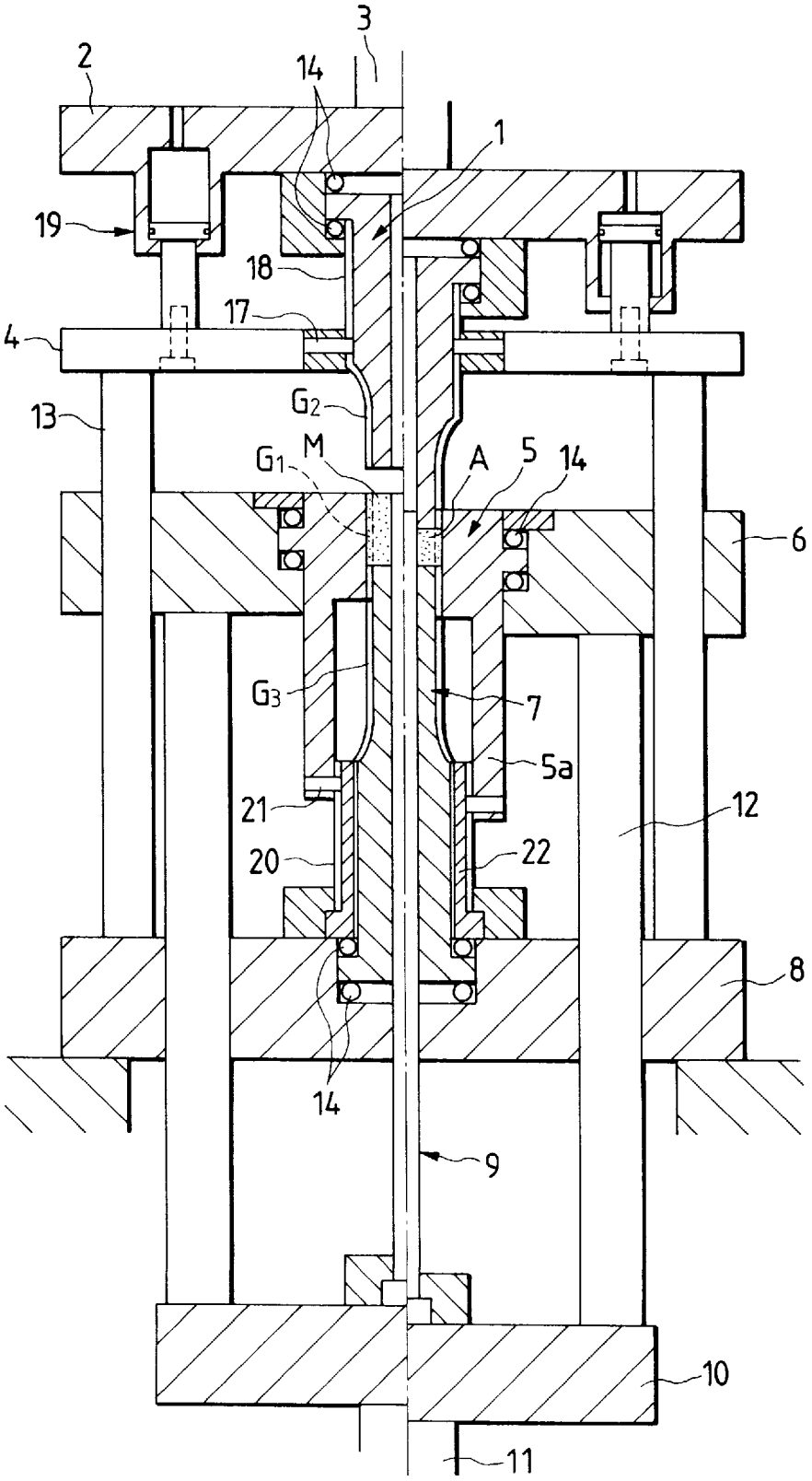
FIG. 4 is a sectional view showing a mode of embodiment of the invention (a powder compacting apparatus for forming an external helical gear wheel).

A powder compacting apparatus, which is a mode of embodiment of the invention, is shown in FIG. 4. This is an apparatus for forming an external helical gear wheel. Helical gear contour, $G_1$, is formed on an inner circumferential portion of a die 5. Further, helical gear contours $G_2$, $G_3$ meshable with the helical gear contour $G_1$ of the die are formed on external circumferential portions of an upper punch 1 and a lower punch 7, respectively.

The upper punch 1 is rotatably mounted on an upper plate 2 through a bearing 14 or the like. Further, a guide groove 18 whose lead is identical to a lead of the helical gear contour $G_1$ is arranged on the upper punch 1. A guide pin 17 is slidably engaged with the guide groove 18. The guide pin 17 is supported by a guide plate 4. Further, the guide plate 4 is suspended from the upper plate 2 through a cylinder 19 or the like.

The die 5 is rotatably mounted on a die plate 6 using the bearing 14. The die 5 has a cylindrical guide pin holder 5*a*. A cam follower 21 is attached to the guide pin holder 5*a* so as to project inward.

The die plate 6 is connected to a yoke plate 10 through connecting rods 12 that are slidably inserted into a base plate 8.

Further, the lower punch 7 is rotatably mounted on the fixedly supported base plate 8 using the bearing 14. On the base plate 8 is a cylindrical part with fixed helical lead 22. The cam follower 21 is slidably engaged with a guide 20 disposed on the outer circumference of the part with fixed helical lead 22, the guide 20 having a lead identical to the lead of the helical gear contour $G_1$. A guide mechanism with fixed helical lead for guiding the die is thus formed.

A core rod 9 that enters into the die 5 through the center of the lower punch 7 is fixed to the yoke plate 10.

The thus constructed powder compacting apparatus shown in FIG. 4 is operated so that when an upper ram 3 is set at the upper dead point, the upper plate 2, and the upper punch 1, the guide plate 4, and the like mounted on the upper plate 2 are located at a still higher position than a position shown in the left half of FIG. 4. It is under this condition that a powder material M is filled into a cavity.

Then, the upper ram 3 is driven, so that both the upper plate 2 and the upper punch 1 supported by the upper plate 2 start lowering. While the guide plate 4 lowers together simultaneously therewith, the guide plate 4 stops at a position at which the guide plate 4 is abutted against guide stoppers 13 on the base plate 8 (in the condition of the left half of FIG. 4). It is at this position that the upper punch 1 starts rotating while guided by the guide pin 17. As a result, only the upper punch 1 lowers when the rod of the cylinder 19 is pushed down.

This upper punch 1 is set at a rotation start position. That is, the upper punch 1 is positioned so that the helical gear contour $G_2$ is located on an extension of the tooth grooves of the helical gear contour $G_1$ at the position at which the guide plate 4 is abutted against the guide stoppers 13. Therefore, when the upper punch 1 enters into the die 5, the helical gear contours $G_1$, $G_2$ mesh with each other correctly.

The powder material M is thereafter compressed by the upper punch 1 as it is further lowered. During this process, the upper and lower punches 1 and 7 flex, so that a lead-phase shift between the helical gears of both punches is corrected by the rotating of the lower punch 7.

The upper punch 1 is engaged with the guide pin 17, and the die 5 is engaged with the guide 20. However, when the upper punch 1 flexes and the helical gear contours $G_2$ and $G_1$ are thereby put out of phase with each other, the die 5 rotates up to such a position as to correct the phase error. As a result, no unintentional, excessive force is applied to the meshed portion between the helical gear contours $G_1$ and $G_2$, but also to the engaged portion between the guide pin 17 and the guide groove 18 and the engaged portion between the guide 20 and the cam follower 21. The lower punch 7 rotates to such a position as to mesh unforcedly with the helical gear contour $G_1$ of the die 5 whose phase has been corrected by rotation.

Upon completion of the compressing operation (in the condition shown by the right half of FIG. 4), a lower ram 11 is driven, so that the die 5 and the core rod 9 are lowered from the compression-completed point. As a result, a green compact A is ejected out of the die 5. At this time, the die 5 lowers by rotating while guided by the guide 20 whose lead is identical to the lead of the helical gear $G_1$. Hence, the green compact A is ejected out of the die 5 without being rotated.

Upon completion of the ejecting operation, the upper punch 1 returns, and the die 5 and the core rod 9 also return to the original positions after the green compact has been taken out. Then, the powder is supplied again, and the above operations are repeated.

Figure 5:
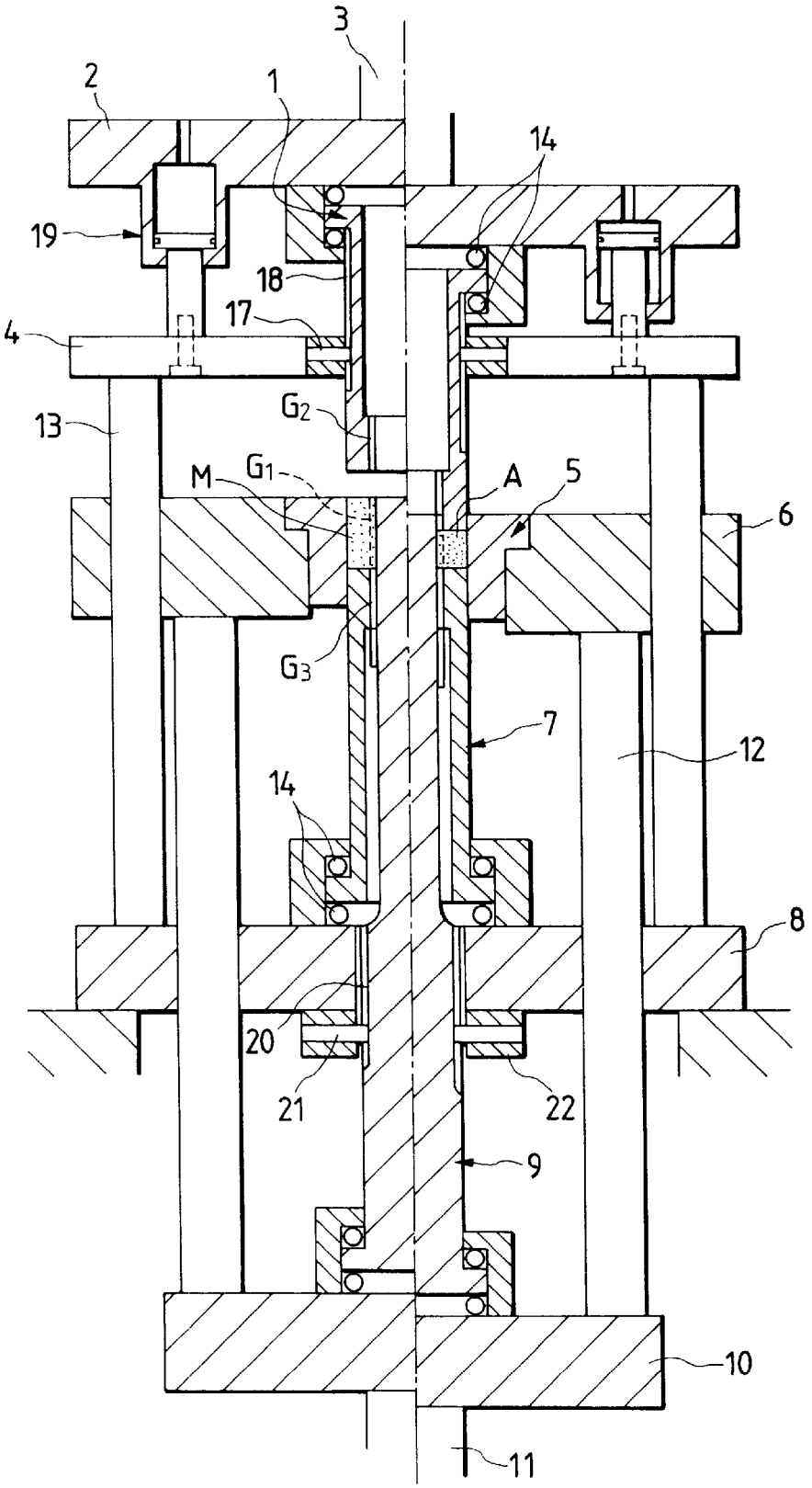
FIG. 5 is a sectional view showing another mode of embodiment of the invention (a powder compacting apparatus for forming an internal helical gear wheel).

FIG. 5 is a powder compacting apparatus for forming an internal helical gear wheel, which is another mode of embodiment. This apparatus is constructed as follows. The core rod 9 is rotatably supported on the yoke plate 10, and the die 5 is fixed to the die plate 6. The helical gear contour $G_1$, is formed on the outer circumferential portion of the core rod 9, and helical gear contours $G_2$, $G_3$ meshable with the helical gear contour $G_1$ are formed on the inner circumferential portions of the upper and lower punches 1, 7, respectively, while rotatably supported thereon.

Further, the guide 20 whose lead is identical to the lead of the helical gear $G_1$ is formed on the core rod 9, and the cam follower 21 attached to the part with fixed helical lead 22 is slidably engaged with the guide 20. The guide mechanism with fixed helical lead for guiding the core rod 9 is thus constructed.

Since other constructional aspects of this apparatus are the same as those of the apparatus shown in FIG. 4, descriptions thereof will be omitted while denoting the same elements by the same reference numerals.

This apparatus prevents the green compact A from rotating as a result of the core rod 9 being rotated by the guiding action of the guide 20 at the time of ejecting the green compacts A out. Further, the die is protected at the time of compressing the powder material as follows. The core rod 9 rotates up to such a position as to correct a lead-phase shift caused between the helical gear contours $G_1$, $G_2$ by the flexing of the upper and lower punches 1, 7. Then, the lower punch 7 rotates to such a position as to correct the phase shift between the helical gear contour $G_1$, and the helical gear contour $G_3$ of the core rod 9. Since other operational and functional aspects of this apparatus are the same as those of the apparatus shown in FIG. 4, descriptions thereof will be omitted.

Figure 6A:
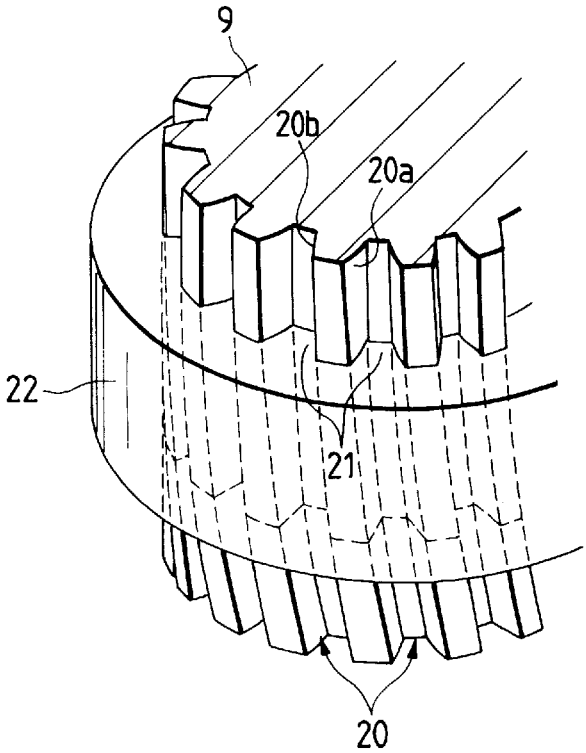
FIG. 6A is a perspective view of a guide mechanism with fixed helical lead formed by a helical tooth-helical tooth combination.
Figure 6B:
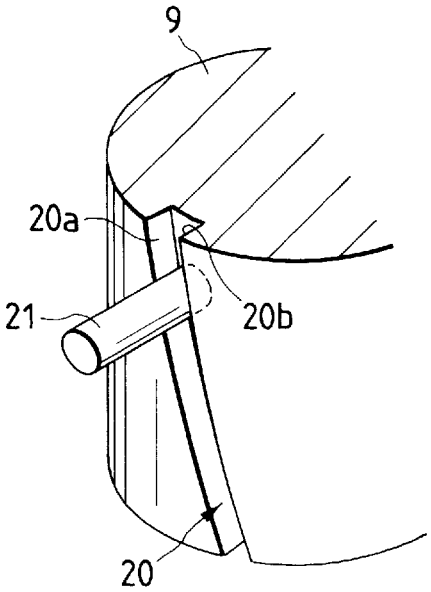
FIG. 6B is a perspective view of a guide mechanism with fixed helical lead formed by a guide groove-pin combination.
Figure 6C:
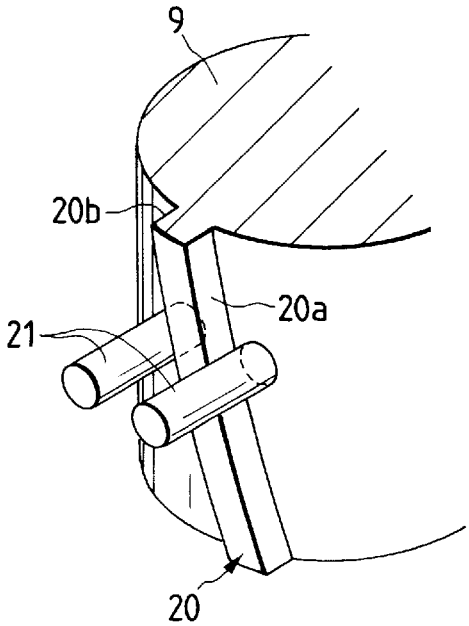
FIG. 6C is a perspective view of a guide mechanism with fixed helical lead formed by a (projected) helical tooth-pins combination.

FIGS. 6A–6C shows the guide mechanism with fixed helical lead for guiding the core rod arranged on the apparatus shown in FIG. 5 in detail. The guide 20 arranged on the core rod 9 and the cam follower 21 arranged on the part with fixed helical lead 22 shown in FIG. 5 may take any of the following combinations: a helical tooth-helical tooth combination shown in FIG. 6A; a guide groove-pin combination shown in FIG. 6 B; and a (projected) helical tooth-pins combination shown in FIG. 6C, as long as the guide 20 has a cam for filling 20*a* and a cam for pressing and ejecting 20*b*, both cam surfaces have the same lead as the helical gear for forming ($G_1$ shown in FIG. 5), the cam for pressing and ejecting 20*b* faces opposite to the cam for filling 20*a*, and the cam follower 21 is engageable with the two cam surfaces 20*a*, 20*b*. Further, the arrangement of the guide 20 and the cam follower 21 is acceptable as long as the guide 20 and the cam follower 21 are arranged so as to correspond to the core rod 9 and the part with fixed helical lead 22, respectively. That is, the guide 20 may be arranged on the part with fixed helical lead 22 and the cam follower 21 may be arranged on the core rod 9 in contrast to the cases shown in FIGS. 6A to C.

It suffices to provide only one set of the guide 20 and the cam follower 21 as long as rigidity requirements can be met. However, in consideration of a reduction in the load applied to the guide and of rotational balance of the core rod 9 at the time of ejecting the green compact out, it is preferred that a plurality of sets be arranged around the circumference at an interval.

It may be noted that the thus described construction of the guide mechanism with fixed helical lead may be applied also to the guide mechanism with fixed helical lead for guiding the die that is to be arranged on the powder compacting apparatus for forming an external helical gear wheel.

Figure 7A:
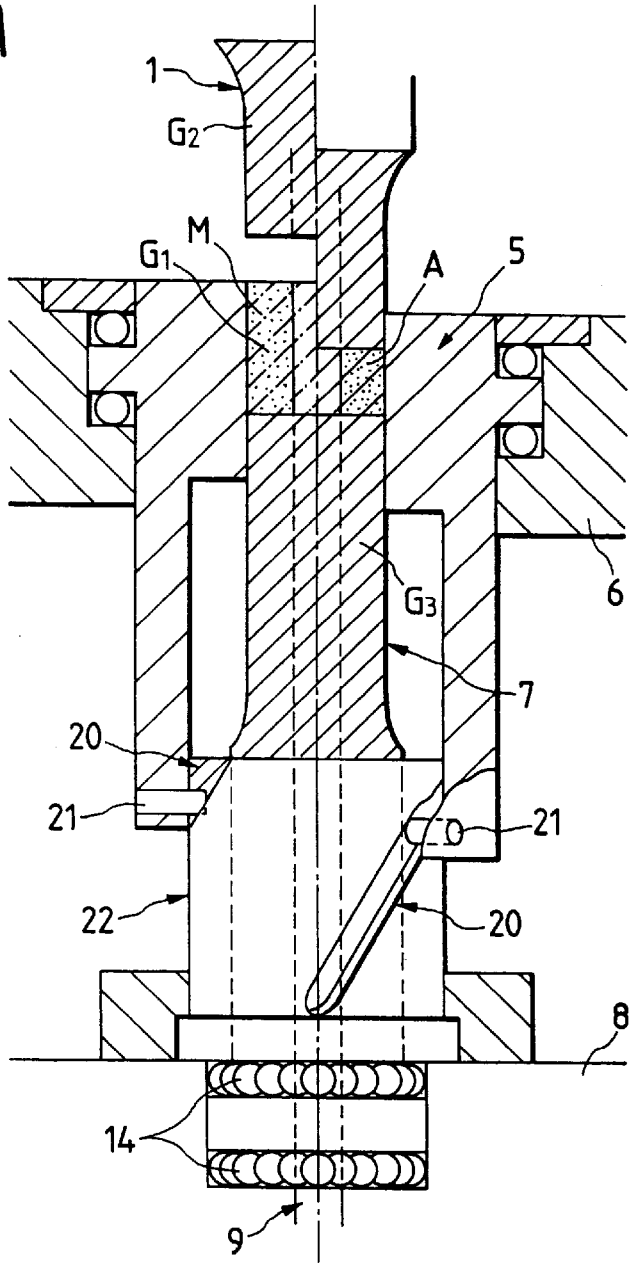
FIG. 7A is a sectional view of a guide mechanism with fixed helical lead having a relief portion arranged in a cam for filling of the apparatus shown in FIG. 4.
Figure 7B:
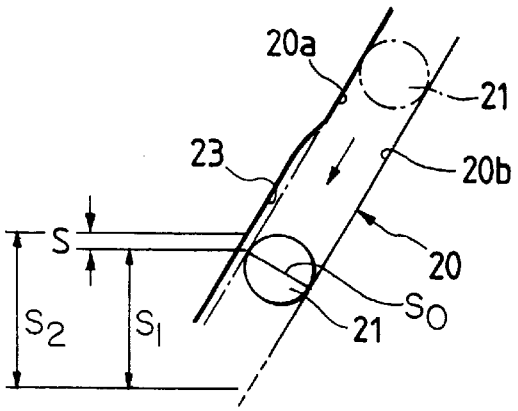
FIG. 7B is an enlarged front view of the relief portion shown in FIG. 7A.
Figure 8A:
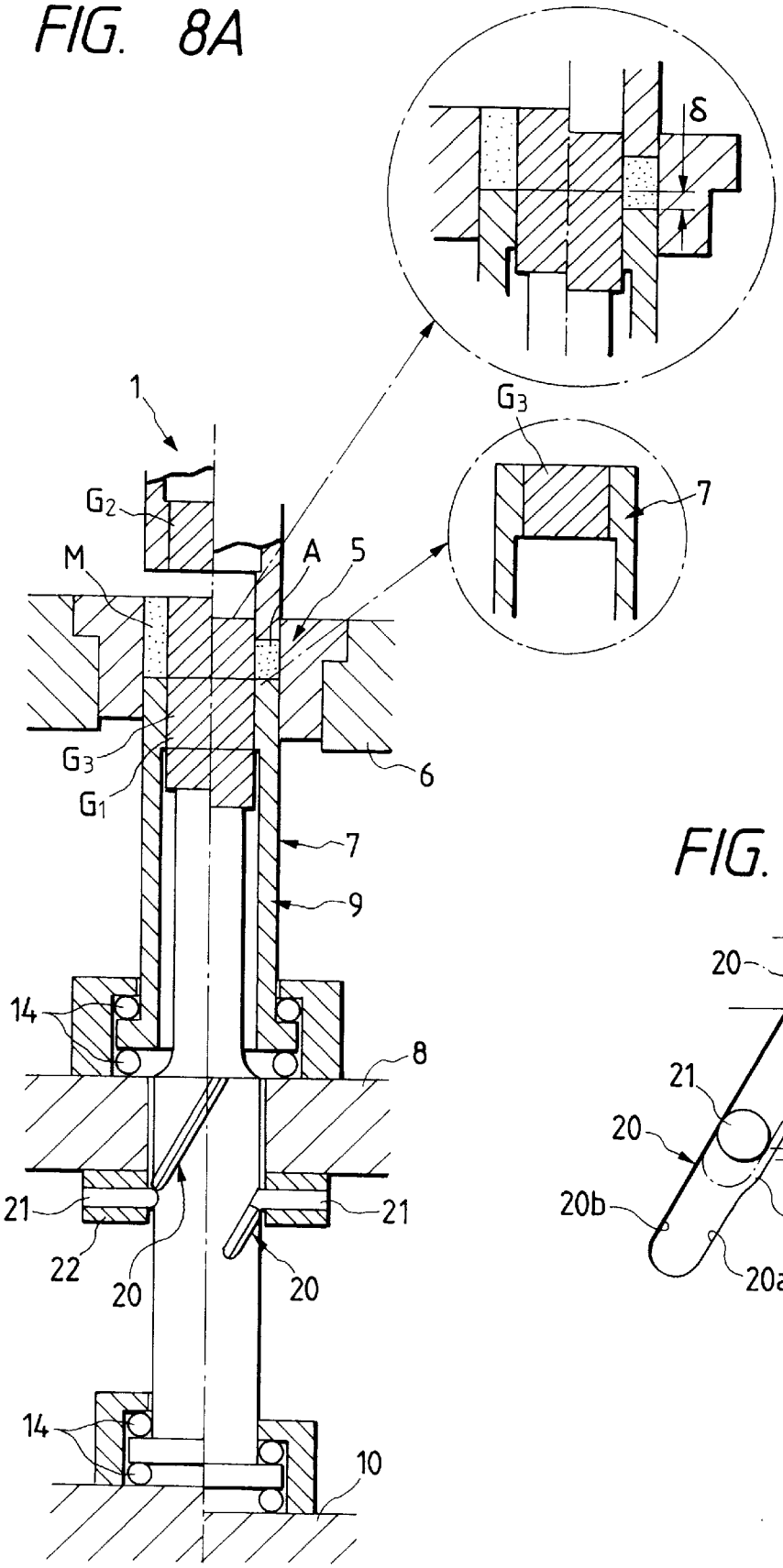
FIG. 8A is a sectional view of a guide mechanism with fixed helical lead having a relief portion arranged in a cam for filling of the apparatus shown in FIG. 5.

Then, a case where a green compact A rotation preventing function is given to the die guide mechanism with fixed helical lead of the apparatus shown in FIG. 4 is shown in FIGS. 7A–7B, the function serving to prevent the green compact A form being rotated by restitution of the lower punch 7 from flexure. FIG. 8 shows a case where a similar function is given to the core rod guide mechanism with fixed helical lead of the apparatus shown in FIG. 5. While the helical gear contours $G_1$, $G_2$, $G_3$ and the guide 20 are indicated linearly in FIGS. 4 and 5, these helical gear contours $G_1$, $G_2$, $G_3$ and the guide 20 actually spiral while inclined at the same angle in the same direction as shown in FIGS. 7A and 8A.

In FIGS. 7A, 7B, 8A and 8B, the guide 20 is formed into a groove having a predetermined lead, and the cam follower 21, which is a round pin, is engaged with such groove. It may be noted that the guide 20 is formed so that the downwardly facing groove surface thereof serves as the cam for filling 20*a* and that the upwardly facing groove surface serves as the cam for pressing and ejecting 20*b* in FIGS. 7A and 7B; that the upwardly facing groove surface serves as the cam for filling 20*a* and the downwardly facing groove surface serves as the cam for pressing and ejecting 20*b* in FIGS. 8A and 8B.

In the construction shown in FIGS. 7A and 7B, the cam follower 21 that has been at the position shown by the chain line in FIG. 7B at the time of feeding the powder material moves to the position shown by the solid line in FIG. 7B upon completion of the compression operation. Further, in the construction shown in FIGS. 8A and 8B, the guide 20 that has been at the position shown by the chain line in FIG. 8B moves to the position shown by the solid line in FIG. 8B.

Figure 8B:
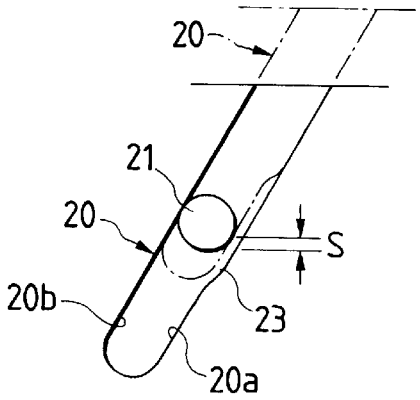
FIG. 8B is an enlarged front view of the relief portion shown in FIG. 8A.

Relief portions 23 for avoiding interference and providing axially extending spaces S between the cam followers 21 and the cam for fillings 20*a* at the compression-completed positions shown in FIGS. 7B and 8B are arranged on the cam for fillings 20*a*, respectively. The value S is determined to satisfy $S \geqq \delta$, assuming that the amount of flexure of the lower punch 7 during compressing is $\delta$.Further, each relief portion 23 does not extend to the powder feed position. Still further, a space between the yoke plate 10 (not shown in FIG. 7) and the lower ram (not shown in FIGS. 7 and 8) or the like is arranged, so that the yoke plate 10 can follow the expansion of the lower punch 7.

If such arrangement is made, when the lower punch 7 that has flexed during compression expands by $\delta$ as a result of elastic restitution thereof, the green compacts A is also raised by $\delta$ together with the die 5 and the core rod 9, which in turn blocks relative displacement of the green compact meshed with the die 5 or the core rod 9 through the helical gear. As a result, the green compact is prevented from being rotated.

It is desirable that an axially extending space equivalent to at least an amount of flexure of the upper punch be provided between the cam for filling of the guide groove 18

(see FIGS. 4 and 5) for guiding the upper punch 1 and the guide pin 17 by arranging a similar relief portion on the cam for filling in order to prevent the die 5 or the core rod 9 from rotating as a result of restitutive expansion of the upper punch 1, the die 5 or the core rod 9 having meshed with the upper punch 1 through the helical gear.

As described in the foregoing, in a powder compacting apparatus for forming an external helical gear wheel, an upper punch, a die, and a lower punch are rotatably supported, and in a powder compacting apparatus for forming an internal helical gear wheel, an upper punch, a lower punch, and a core rod are rotatably supported. Therefore, even if the lower punch flexes during compression, the lower punch rotates to thereby spontaneously correct a lead-phase shift between the helical gear contours of the upper and lower punches. As a result, no unintentional, excessive force is applied to the meshed portion of the helical gears, and the engaged portion of the cam follower of the guide mechanism with fixed helical lead for guiding the die or the core rod. Hence, effects for protecting the die assembly can be improved.

Further, the die or the core rod having a helical gear contour is guided to the guide mechanism with fixed helical lead disposed between itself and the part with fixed helical lead, and lowered while rotating in accordance with the lead of the helical gear contour thereof. Therefore, the green compact is ejected out of the die without being rotated. As a result, effects for preventing the green compact from chipping and cracking can be improved.

Still further, if a relief portion is arranged on the cam for filling of the guide, when the lower punch that has flexed during compression returns, the green compact follows restitutive expansion of the lower punch together with the die and the core rod without being rotated. As a result, the green compact is not rotated by restitution of the lower punch from flexure. Hence, effects for preventing the green compact from chipping and cracking can be made further reliable.

In addition, since the number of additional parts and improved portions is small, the possibility of increasing and complicating the structure of an apparatus and increasing the cost of manufacture can be reduced, which in turn allows an inexpensive and highly reliable powder compacting apparatus for a helical gear to be provided.

What is claimed is:

1. A powder compacting apparatus for forming an external helical gear wheel, comprising:

a die having a helical gear contour formed on an inner circumferential portion thereof, an upper punch and a lower punch respectively having helical gear contours formed on outer circumferential portions thereof, the helical gears being meshable with the helical gear contour formed on the die;

a core rod; and a guide mechanism with a fixed helical lead for guiding the die, said fixed helical lead being identical to a lead of the helical gear contour formed on the die, wherein the die, the upper punch, and the lower punch are rotatably supported; the guide mechanism with said fixed helical lead comprises a guide having a cam for filling and a cam for pressing and ejecting disposed opposite to the cam for filling and a cam follower slidably engaging with the guide;

said cam for filling has a relief surface by which is formed a first axially extending spacing $S_1$ and a second axially extending spacing $S_2$ between said cam for filling and said cam for pressing and ejecting wherein said first axially extending spacing $S_1$ is sufficient to accommodate the width of said cam follower and said second axially extending spacing $S_2$ further comprises an axially extending space S such that $S_2=S_1+S$;

the upper punch meshes with the die through the helical gear contours and is pushed into the die while rotating, so that a powder material within a cavity formed by the die, the upper punch, the lower punch, and the core rod is compressed; and a green compact formed after the powder material has been compressed is ejected out of the die in an axial direction of the die and the core rod relative to the upper punch and the lower punch; and during compression of the powder material, the amount of flexure of the lower punch during compressing is $\delta$ such that $\delta \geqq S$ and during restitutive expansion of said lower punch, the green compact is prevented from rotating.

2. The powder compacting apparatus according to claim 1, wherein the die is engageable with the guide and the cam follower is formed on said guide mechanism.

3. The powder compacting apparatus according to claim 1, wherein the guide is formed on the core rod and the cam follower is formed on said guide mechanism.

4. A powder compacting apparatus for forming an internal helical gear wheel, comprising:

a core rod having a helical gear contour formed on an outer circumferential portion thereof, a die;

an upper punch and a lower punch respectively having helical gear contours formed on inner circumferential portions thereof, the helical gears being meshable with the helical gear contour formed on the core rod; and a guide mechanism with a fixed helical lead for guiding the core rod, said fixed helical lead being identical to a lead of the helical gear contour formed on the die, wherein said core rod, said upper punch, and said lower punch are rotatably supported;

said guide mechanism further comprises a cam for filling and a cam for pressing and ejecting such that said cam for filling has a relief surface by which is formed a first axially extending spacing $S_1$ and a second axially extending spacing $S_2$ between said cam for filling and said cam for pressing and ejecting wherein said first axially extending spacing $S_1$ is sufficient to accommodate the width of said cam follower and said second axially extending spacing $S_2$ further comprises an axially extending space S such that $S_2=S_1+S$;

said upper punch meshes with said core rod through said helical gear contours and is pushed into said die while rotating, so that a powder material within a cavity formed by said die, said upper punch, said lower punch, and said core rod is compressed; and a green compact that is formed after the powder material has been compressed is ejected out of the die in an axial direction of the die and the core rod relative to the upper punch and the lower punch; and during compression of the powder material, the amount of flexure of the lower punch during compressing is $\delta$ such that $\delta \geqq S$ and during restitutive expansion of said lower punch, the green compact is prevented from rotating.

5. The powder compacting apparatus according to claim 4, wherein the cam follower is formed on said guide mechanism.

6. The powder compacting apparatus according to claim 4, wherein the guide is formed on the core rod and the cam follower is formed on said guide mechanism .

7. A powder compacting apparatus according to claim 1 or 4, wherein the cam follower is a pin which contacts a cam surface of the guide.

8. A method of forming a helical gear wheel using said powder compacting apparatus according to claim 1 or 4 comprising the steps of:

providing said powder compacting apparatus;

compressing powder material charged into the cavity with the upper punch and the lower punch to form a green compact and releasing the compression on the green compact wherein during compression of the powder material, the amount of flexure of the lower punch during compressing is $\delta$ such that $\delta \leqq S$ and during restitutive expansion of said lower punch, the green compact is prevented from rotating; and ejecting a green compact out of the die, wherein the die or the core rod follows the lower punch without being rotated when the lower punch returns to its original position from flexure.

* * * * *